United States Patent [19]

Meshberg

[11] 4,034,899

[45] July 12, 1977

[54] VALVE CONSTRUCTION

[76] Inventor: Philip Meshberg, 85 Old Oak Road, Fairfield, Conn. 06430

[21] Appl. No.: 630,953

[22] Filed: Nov. 12, 1975

Related U.S. Application Data

[63] Continuation-in-part of Ser. No. 560,205, March 20, 1975, abandoned.

[51] Int. Cl.[2] ..... B65D 83/14

[52] U.S. Cl. ..... 222/321; 222/402.2

[58] Field of Search ..... 222/320, 402.2, 321; 137/627.5

[56] References Cited

U.S. PATENT DOCUMENTS

| | | | |
|---|---|---|---|
| 2,858,053 | 10/1958 | Waldherr | 222/402.2 |
| 3,464,596 | 9/1969 | Meshberg | 222/402.2 |
| 3,877,617 | 4/1975 | Stevens | 222/321 |

*Primary Examiner*—Stanley H. Tollberg

*Assistant Examiner*—Hadd Lane

*Attorney, Agent, or Firm*—Kenyon & Kenyon, Reilly, Carr & Chapin

[57] ABSTRACT

An improved plastic seal valve for the bottom of the chamber of a dispensing device in which a valve stem operates. The valve stem is hollow and contains a cross hole which is normally located just above an annular plastic seal made between the housing and the stem at the bottom of the tank, the cross hole porting the hollow stem, with the plastic seal allowing closer tolerances in manufacture of the stem and allowing greater accommodation for such distortions as may still occur in molding through flexibility in the bottom stem portion the stem having a taper that just release the sealing pressure and functions on the bottom seal as the upper seal closes. In addition a weaker spring may be used, thus, making it easier to operate the valve while at the same time obtaining improved sealing over the life of the valve.

10 Claims, 3 Drawing Figures

VALVE CONSTRUCTION

RELATED APPLICATIONS

This application is a continuation-in-part of application Ser. No. 560,205 filed Mar. 20, 1975, now abandoned.

BACKGROUND OF THE INVENTION

This invention relates to valves for metered aerosol valve chambers and pump chambers in general and more paticularly to an improved construction in such valves permitting a better seal between the valve stem and chamber.

One problem existing in prior art aerosol valves relates to the sealing at the bottom of the metering chamber. Typical of such sealing is that disclosed in my prior U.S. Pat. No. 3,464,596. As disclosed therein, the bottom of the valve stem is ribbed so that when the valve is in the upward, nondispensing position, flow channels from the aerosol container to the metering chamber are established, allowing the metering chamber to fill with the material to be dispensed. Although this arragement works quite well, it has a number of disadvantages. First, because of the ribbed construction at the base of the stem, it is difficult to mold the portion directly thereabove, which portion forms a plastic valve seal, to close tolerances. The result of the ribbed construction is that distortions occur in this area. In order to maintain a good seal, it is then necessary to have a tighter fit than would ordinarily be necessary. Because of this, the spring used for returning the valve stem to its non-dispensing position must be relatively strong. To obtain the required spring force, the spring may be required to virtually fill the metering chamber including that part directly above the plastic seal. Since the spring cannot be reliably constructed to be free of burrs at its end, such burrs may be present and can result in scoring on the sealing portion of the stem. This scoring of the stem along with the distortion resulting from the ribbed construction results in the possibility of inconsistent shut-off and wear at the seal when the stem is depressed, causing loss of vapor or spitting of the product.

Pumps such as that disclosed in my previous U.S. Pat. No. 3,211,346 use the same type of valve to close the pump chamber and can exhibit the same problems.

Thus, it is clear that there is a need in a valve of this nature for an improved type of seal at the inlet to a metering or pump chamber.

SUMMARY OF THE INVENTION

The metering valve or pump of the present invention has an improved plastic seal at the bottom entrance into the metering or pump chamber which avoids the type of problems present in the prior art. Rather than using the ribbed construction of the prior art, the base of the stem in the valve of the present invention is hollow. At a point which is directly above the sealing point in the unoperated position, a cross hole permitting communication between the hollow inner portion of the stem and the metering chamber is provided. A similar arrangement is used in my previous U.S. Pat. No. 2,968,427 which employed a rubber gasket at the bottom of the chamber. However, such has not been extensively used in plastic seals which are more comonly of ribbed construction. It has been found that, because of the elimination of the ribbed construction, and because of the thin wall construction, closer tolerances may be maintained in plastic moldings of this part and that some flexibility in the seal wall may be realized which helps compensate for any molding distortion of the stem or housing that may occur. Thus, an excellent seal can be obtained with lower forces than was heretofore possible.

In addition, the lower end of the valve stem is made with a slight taper, to relieve pressure and frictional drag on the seal when closing.

As a result of the above construction, a smaller and lighter spring may be used. This in turn permits the spring being located above the sealing portion of the stem eliminating any change of scoring of the stem by burrs on the spring. The construction also permits extending the thin portion of the wall forming the bottom of the metering or pump chamber upward so that the sealing area can flex under the pressure within the container to thereby assure a positive shut-off throughout the life of the package.

DETAILED DESCRIPTION OF THE PREFERRED EMBODIMENT

Figure 1:
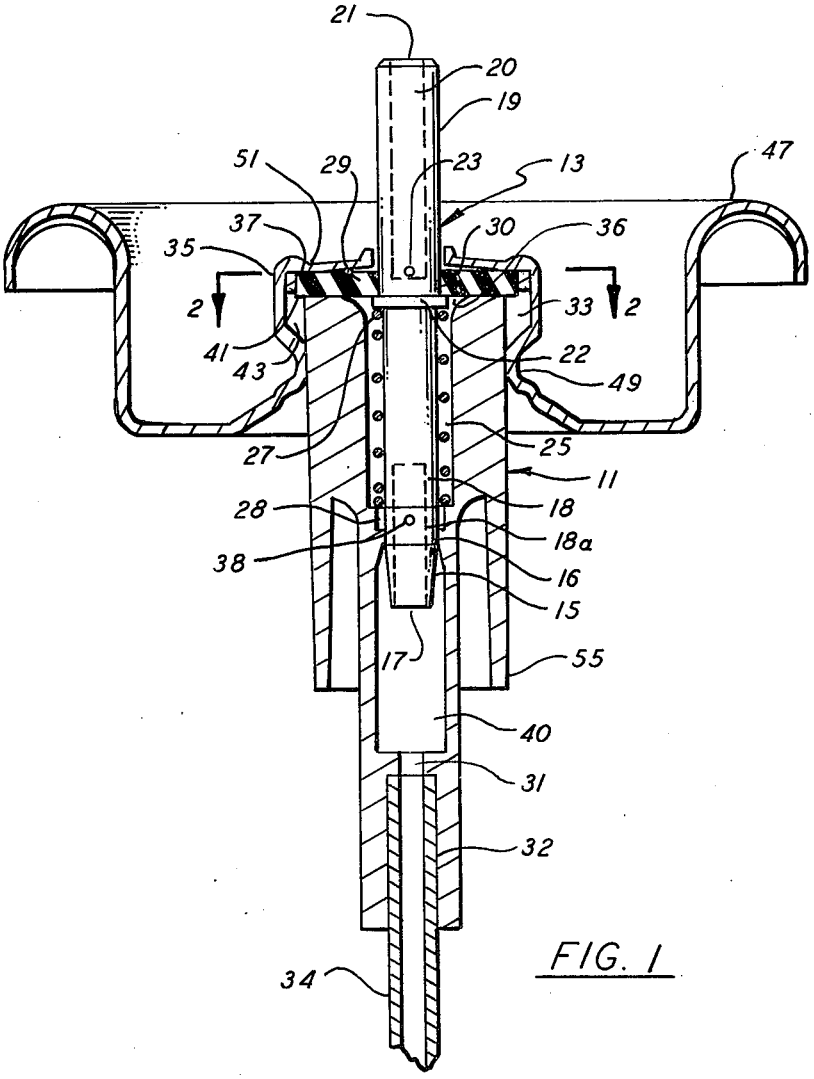
FIG. 1 is a cross-sectional view of the valve and mounting cup according to the present invention as applied to a metering valve.

FIG. 1 illustrates the valve of the present invention as applied to a metering valve. The metering valve comprises a valve housing 11 and valve stem 13. The valve housing 11 has an enlarged or flanged cylindrical top portion 33. The outside dimensions of the top portion 33 are indicated by the circle 35 on the plan view of housing shown on FIG. 2. A walled annular recess 36 is formed in the cylindrical portion with its inner wall represented by the solid line 37.

A sealing gasket 29 having an aperture 30 is placed into the recess formed in the top of the valve housing and a mounting cup 47 placed over the valve housing and sealing gasket. The mounting cup is then crimped around the enlarged portion 33 of the valve with a crimp 49. An additional annular crimp 51 is made in the top of the mounting cup to insure improved sealing between the mounting cup and the valve housing 11. The mounting cup is then crimped to the can in conventional fashion.

The valve stem 13 comprises essentially three sections: a tapered cylindrical bottom section 15; a central cylindrical portion 18; and a cylindrical top portion 19 having a longitudinal dispensing passage 20, the end of which forms the outlet port 21 of the valve. A flange 22 separates the sections 18 and 19. The bottom section 15 cooperates with an inner wall 16 of housing, to guide the valve. A port 23 is formed in the wall of the cylindrical portion 19 to permit communication of the passage 20 and outlet port 21 with the chamber 25 in the valve body. Valve stem 13 has its portion 19 inserted through the aperture 30 in sealing gasket 29.

The valve, as shown, is in non-operated position. A spring 27 pushes against the flange 22 urging it upward so that the port 23 is above the sealing gasket 29. The bottom of spring 27 rests on a flange 28 formed inside tank 25. Sealing gasket 29 is in sealing contact with the portion 19 and flange 22. When in this position, material from the container to which the valve is mounted flows through an aperture 31 above a cylindrical recess 32 in the bottom of housing 11, which recess has a dip tube 34 inserted therein. It flows through a hollow portion 17 of stem 13 and out through a crosshole 38 into the tank chamber 25. The valve shown is a metering valve. Only the amount of material which flows ito the chamber 25 when the stem is all the way up will be dispensed. When the stem is pushed down, chamber 25 is effectively sealed at its bottom by the section 18*a* of portion 18 above the tapered section 15, at which section the cross hole 38 is located, moving down into a sealing relationship with sealing wall 16.

Through the use of the hollow recess 17 and the crosshole 38, rather than the ribbed construction shown in my prior patent reference above, the section 18*a* of the stem above the tapered portion 15 can be made to closer tolerances insuring a good seal with low forces between that section of the stem and the sealing wall 16. As a result, the flange 28 on which the bottom of spring 27 rests, can be formed above the section 18*a* of the stem 13 which comes into sealing relationship with the sealing wall 16 and, thus, the spring cannot score the section 18*a* of the stem which is used to maintain a seal. When the stem 13 is depressed to dispense material, only the material which is contained within the chamber 25 under pressure will be forced through the port 23 and out through exit port 21. As a result, a controlled amount of material will be dispensed without any loss of vapor or spitting of the product due to the excellent seal maintained between the sealing wall 16 and the stem section 18*a*. Because of the low force required to maintain a good seal between the stem section 18*a* and sealing wall 16, the spring 27 may be shorter and lighter than would normally be required.

Figure 3:
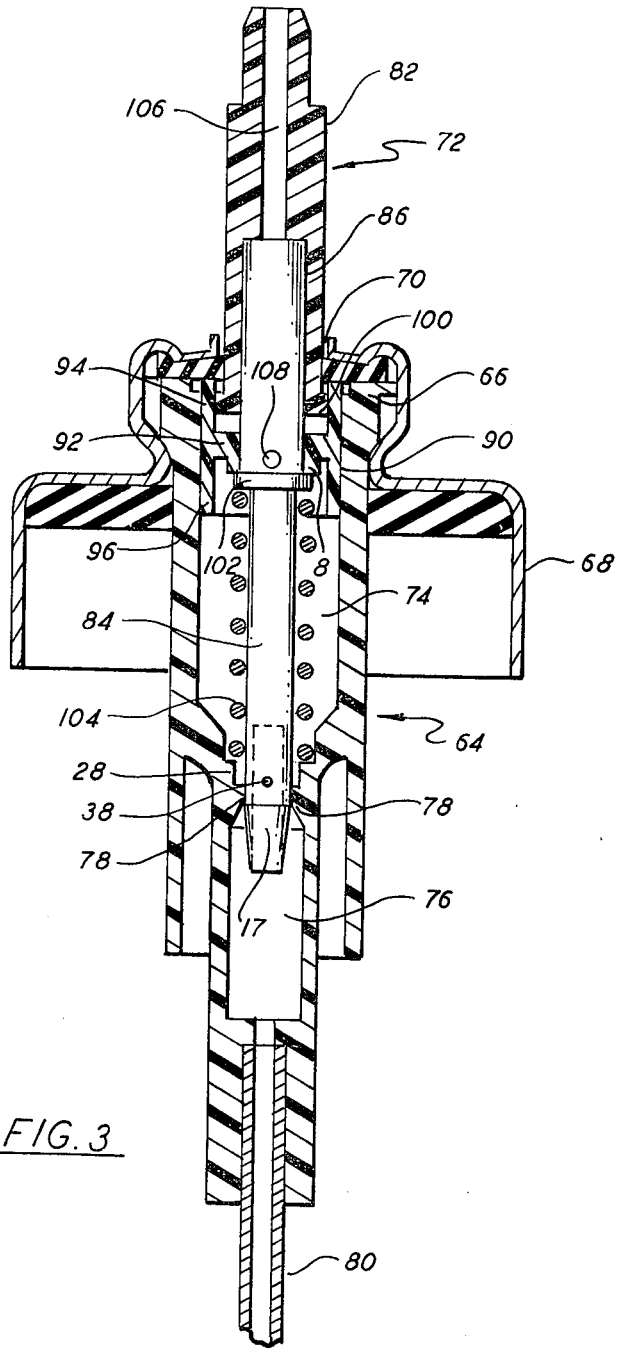
FIg. 3 is a cross-sectional view of the valve of the present invention used with a pump.

Furthermore, the valve housing 11 has a thick wall at the upper portion of the tank 25 with a thinner wall in the area of the seal 16. The thinner area is surrounded by a depending flange 55. This construction adds to the flexibility of the tank at the point of sealing and allows the pressure in the container to act on the outside walls at this point to aid in sealing. FIG. 3 shows a cross-sectional view of a pump incorporating the valve of the present invention. The pump assembly includes a mounting cup 68 which will engage the upper walls of the container in conventional fashion mounted on the mounting cup and extending within the container is a hollow tubular pump body 64 having a bulbously enlarged, upper end region 66. The mounting cup is crimped about the upper end 66 of the pump body in a manner to be more fully described below. A central opening 70 extending through the engaging portion 68 of the mounting cup loosely encircles the upper end of plunger 72 extending into the pump body. The pump body 64 also includes aligned cylindrical, upper and lower chambers 74 and 76 separated by a transverse wall having a throat 78, of smaller diameter than either chamber. The lower chamber 76 communicates with the liquid in the container through a dip tube 80 extending downwardly into the liquid. The upper chamber 74 is also called the pump chamber or central housing.

The previously mentioned stem or plunger 72 comprises rod-like upper and lower bodies 82 and 84 respectively with the lower body being force-fitted or adhesively secured into a bore 86 at the lower end of the upper stem portion. The lower plunger body 84 has upper and lower portions of relatively greater and lesser diameter and its lower end is slidingly and sealingly received in the previously mentioned throat 78 between the chambers of the pump body.

Figure 2:
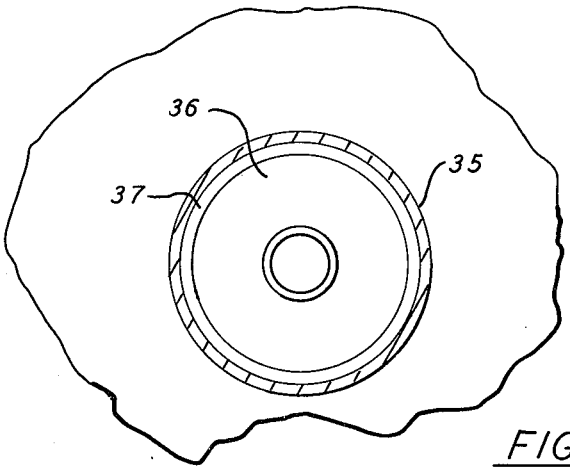
FIg. 2 is a plan view of the valve of FIG. 1.

Liquid can pass from the lower chamber 76 to the the upper or pump chamber 74 when the plunger 72 is in a raised position shown in FIG. 2 through the lower hollow passage 17 formed in the lower end of the lower body 84 of the plunger extending through the throat and through cross hole 38. i.e. this valve member at the bottom is exactly as described above in connection with FIG. 1.

The liquid admitted to the pump chamber 74 is expelled by a piston 90 mounted for sliding motion within the pump chamber. The piston assembly 90 includes a central, annular piston body 92 extending radially between the upper, enlarged diameter portion of the plunger body 84 and the adjacent interior wall surface of the upper chamber 74, in sliding, sealing relation with both. Extending above and below the piston body 92 along its peripheral edge are upper and lower annular flanges 94 and 96, respectively. An annular, inner lip 98 extends about the inner peripheral edge of the piston body and extends downwardly for a shorter axial distance than the lower flange 96. The piston 90 is slidble on the upper part of the plunger lower body 84 between upper and lower limit members constituted by flanges 100 and 102, respectively. The flange 100 extends about the lower end of the plunger upper body 82 and the flange 102 extends about the lower end of the enlarged upper part of the plunger lower body 84. In a normal condition of repose, a compression spring 104 surrounding the lower part of the plunger lower body 84 and extending between the lower limit member 102 and the flange 28 urges the plunger 72 to the upper end of the upper chamber 74 as shown in FIG. 3. As with the embodiment of FIG. 1, the bottom of the spring rests on a flange 28 keeping its bottom above the sealing area on the plunger lower body 84.

To provide an outlet for liquid from the upper chamber 74, an axially extending outlet passage 106 extending upwardly of the plunger 72 through its lower and upper bodies 84 and 82 is provided. The lower end of the outlet passage 106 is constituted by an intersection transverse radial bore or discharge port 108 which, when the plunger is in the raised position, is overlapped or blocked by the piston body 92 and inner lip 98 thereby preventing fluid communication between the pump chamber below the piston and the outlet passage 106. The inside surface of piston portion 92, 96 and the outside cylindrical surface of the lower plunger body 84 cooperate to form a sliding valve means for opening and closing the discharge port 108.

In operation the upper end of the plunger 72 is pressed downwardly. During initial movement the crosshole 38 in the plunger moves below the throat 18 preventing fluid flow from the upper chamber through it and the lower passage 17. Then, as a result of a slight build up of pressure and with friction between the piston and the chamber wall, the plunger slides downwardly through the piston to move the lower end 108 of the outlet passage into the upper chamber 74. The same initial movement also brings the upper limit member, the flange 100 on the lower end of the upper plunger body, into contact with the upper surface of the piston assembly downwardly of the chamber 74 so that the liquid trapped in the upper chamber is expelled through the outlet passage 106. During the downward motion the hydraulic pressure in the upper chamber presses the lower flange 96 of the piston, which is made of a plastic having at least a limited degree of resilience, against the chamber wall to increase the sealing effect. Usually a right angled spray nozzle will be affixed to the upper end of the outlet passage, which constitutes the liquid outlet, so a spray can be directed horizontally at any designed target. The spray may also be directed vertically.

When the plunger 72 reaches a depressed position at the bottom of its downward travel, in which the piston 90 is located at the lower end of the pump chamber 74, further downward motion is prevented because the coils of the spring 104 reach a rigid, fully compressed condition. Pressure is then removed from the plunger 72 so that the compression spring 104 expands causing an initial upward movement of the plunger from the depressed position. During this initial upward movement friction against the chamber wall again tends to hold the piston immobile so that the plinger travels upwardly through the piston until the lower limit member, the flange 102, is moved into contact with the underside of the lower lip 98. At this time the piston slide valve closes sealing discharge port 108. Continued upward expansion of the spring 144 moves the piston upwardly creating a vacuum within the upper chamber. Finally, as the plunger approaches its initial, raised position, the crosshole 38 of the lower passage 17 moves above the throat 78 placing the upper chamber 74 in communication again with the liquid in the lower chamber 76. At this time, air pressure or low pressure gas within the container acts on the liquid so that it is forced into the low pressure area within the upper chamber created by the upward motion of the piston, thereby priming the upper chamber with liquid ready for the next downward strike of the plunger.

Thus, an improved low pressure seal for use in a metering valve or pump has been disclosed. Although specific embodiments have been illustrated and described, it will be obvious to those skilled in the art that various modifications may be made without departing from the spirit of the invention which is intended to be limited solely by the appended claims.

I claim:

1. In a valve for closing off the bottom of a chamber in a dispensing device including:

a. a plastic housing having in its upper portion a cylindrical bore forming a chamber and having an annular sealing wall of smaller diameter below said chamber;

b. a cylindrical valve stem comprising:

1. an upper portion containing valve means for use in communication between said chamber and a dispenser outlet;
2. a second cylindrical portion below said upper portion and extending through said chamber;
3. a part of the wall of said second portion in sealing contact with said sealing wall;
4. a hollow recess in the bottom of said second portion extending to above the point of contact between said second portion and said sealing wall when said stem is in an upward, unoperated position;
5. a crosshole through said second portion of said valve stem above said annular sealing wall permitting communication between said hollow recess and said chamber when said stem is in said upward, unoperated position;

c. a spring in said chamber closely surrounding said valve stem and urging said valve in an upward direction; and d. means cooperating with said upper chamber to close off said valve means when said stem is in said upward unoperated position, the improvement comprising:

e. a flange formed in said metering chamber above the part of said second portion which contacts said annular sealing wall when said stem is depressed, said flange forming a bottom support for said spring, said flange being displaced upward from said sealing wall a distance at least equal to the stem travel during normal operation.

2. The invention according to claim 1 wherein said valve housing has a thick wall surrounding the major portion of said metering chamber with a thin wall therebelow which extends to above the location of said sealing wall.

3. The invention according to claim 1 wherein said second cylindrical portion is tapered below said crosshole.

4. The invention according to claim 1 wherein said dispensing device is an aerosol metering valve.

5. The invention according to claim 1 wherein said dispensing device is a pump.

6. In a dispensing device including a body forming a chamber and a valve stem disposed for axial movement within said chamber, said valve stem being adapted to discharge materials stored within said metering chamber when depressed and including a spring closely surrounding and urging said valve stem upward into a position where dispensing does not take place, a seal being made between the bottom of said valve stem and the bottom of said chamber, wherein the improvement comprises a plastic seal between said valve stem and the bottom portion of said tank and means for disposing the end of said spring upward from the point of sealing, when at rest, a distance at least equal to the stem travel during normal operation whereby scoring of said stem by said spring is avoided.

7. A method of preventing scoring and obtaining an improved seal in a dispensing device including a body forming a chamber and a valve stem disposed for axial movement within said chamber, said valve stem being adapted to discharge materials stored within said chamber when depressed and including a spring closely surrounding and urging said valve stem upward into a position where dispensing does not take place, a seal being made between the bottom of said valve stem and the bottom of said chamber comprising:

a. establishing a plastic seal between the stem and chamber bottom; and b. mounting the spring so that its bottom end is displaced from the point of sealing by a distance at least equal to stem travel during normal operation.

8. A method of preventing scoring of a valve stem in a dispensing device including a body forming a chamber and a valve stem disposed for axial movement within said chamber, said valve stem disposed for axial movement within said chamber, said valve stem being adapted to discharge material stored within said chamber when depressed and including a spring closely surrounding and urging said valve stem upward into position where dispensing does not take place, a seal being made between the bottom of said valve stem and the bottom of said chamber, comprising locating the bottom of the spring displaced from the point of sealing by a distance at least equal to stem travel during normal operation.

9. The invention according to claim 8 wherein said dispensing device is an aerosol metering valve.

10. The invention according to claim 8 wherein said dispensing device is a pump.

* * * * *